United States Patent [19]

Kulbersh

[11] Patent Number: 4,685,575

[45] Date of Patent: Aug. 11, 1987

[54] WALL MOUNTING SYSTEM FOR SHELVES

[75] Inventor: Irwin Kulbersh, Skokie, Ill.

[73] Assignee: Amco Corporation, Chicago, Ill.

[21] Appl. No.: 893,579

[22] Filed: Aug. 6, 1986

[51] Int. Cl.[4] ..... A47F 5/08

[52] U.S. Cl. ..... 211/90; 108/152; 211/153

[58] Field of Search ..... 211/90, 88, 134, 186, 211/149, 188, 153, 150, 181, 183; 248/235; 108/152

[56] References Cited

U.S. PATENT DOCUMENTS

| | | | |
|---|---|---|---|
| 933,643 | 9/1909 | Gnekow | 211/88 |
| 1,284,235 | 11/1918 | Carlin | 211/90 |
| 4,361,099 | 11/1982 | Kokenge et al. | 108/152 |
| 4,374,498 | 2/1983 | Yellin | 108/152 X |

*Primary Examiner*—Reinaldo P. Machado

*Assistant Examiner*—Sarah A. Lechok Eley

*Attorney, Agent, or Firm*—Laff, Whitesel, Conte & Saret

[57] ABSTRACT

A shelving system is provided for mounting on a wall or similar support surface. The system can comprise one or more shelves at varying heights to accommodate different storage requirements. At first top shelf is mounted on the wall by means of a pair of c-shaped brackets that are secured to the wall and removably hold the back of the shelf and by a pair of braces, each secured to the wall at one end and to opposite sides of the shelf at the other end. Another shelf can be added to the system below the top shelf by means of a second pair of c-shaped brackets secured to the wall below the first pair of brackets and by a pair of support members secured to the top shelf that extend downwardly to support the second shelf. Further shelves can be added to the system below the second shelf in the same manner.

9 Claims, 10 Drawing Figures

WALL MOUNTING SYSTEM FOR SHELVES

FIELD OF THE INVENTION

The present invention relates to a device for mounting a shelving system on a wall. More particularly, the present invention relates to a brace and bracket system for mounting a plurality of shelves on a wall to form a shelving assembly unit or module.

BACKGROUND OF THE INVENTION

Shelving systems comprising a plurality of flat shelves supported by several post members resting on a floor are known in the art. Such systems are often made of metal and are adjustable to vary shelf heights. Individual shelves can be secured to the posts at varying heights to accommodate and support items of various sizes, thus enabling great flexibility as product designs and storage requirements change. An adjustable shelving system has been described in U.S. Pat. Nos. 3,424,111 and 3,523,508.

Similarly, shelving systems comprising a plurality of flat shelves that are supported by braces mounted on a wall are also known in the art. It is often desired to employ a wall-mounted system rather than a shelf assembly supported by several posts resting on a floor under certain circumstances. For example, it may be desired not to have the shelving assembly rest on the floor in order to keep the floor clear of obstructions. Also, the configuration and size of the storage area may dictate that a wall-mounted system is more practical or efficient. Other various reasons dictated by different storage requirements may also make a wall-mounted assembly more feasible than an assembly supported by posts resting on a floor.

Wall mounted shelving assemblies have commonly been supported by a pair of wire welded braces and J-shaped brackets. Typically, two J-shaped brackets are mounted to the wall at shelf height to hold the back of the shelf. Each wire brace is mounted to the wall by means of U-shaped brackets and each brace supports one side of the shelf. The shelf is snapped into the wire braces and is held in place by a friction fit.

Such prior art braces used to mount shelf assemblies to a wall are constructed from a plurality of wire rods welded together to form a frame to support the shelves. Such braces are normally designed to support one, two or three shelves.

Although such brace mounting systems are sufficiently strong to adequately support the shelves, the braces are relatively expensive and time consuming to manufacture. The many wires used to form the brace must be cut to specific lengths, assembled in a welding fixture and all welded together. This is a time consuming process that requires an inordinate amount of labor and, consequently, is relatively expensive. Furthermore, because of the many wire rods that comprise each brace, the braces tend to be rather heavy.

Another limitation of the wire brace mounting system is that the distance between the shelves supported by the system can not be varied. Also, the wire braces are designed to support either one, two or three shelves and are not adaptable to vary the number of shelves. That is, a brace designed to support one shelf is not adaptable to support two or three shelves and a two-shelf brace cannot be adapted to support three shelves. Both of these limitations severely limit the flexibility and adaptability of the wire brace mounting system to accommodate and support items of various sizes to meet varying storage requirements.

A further limitation of the wire brace mountings is that they greatly limit access to the sides of the shelves because of the shape and configuration of the braces.

Still another limitation of prior art wire brace mounting systems is that the shelves can be inadvertently disengaged by unintentional jarring of the shelves. Such disengagement can result in stored items falling off the shelf and becoming damaged or ruined, and also in injuries to any persons in the immediate area struck by the falling items, which are often of substantial weight.

Accordingly, it is an object of the present invention to provide a means for mounting a plurality of shelves on a wall or similar support surface at varying heights and in different configurations to accommodate and support items of various sizes and to meet various storage requirements.

Another object of the invention is to provide a wall-mounted shelving system that is easy and economical to manufacture.

A further object of the invention is to provide a means for mounting a shelving system on a wall that is light weight yet strong enough to support the heavy loads of the shelves.

Yet another object of the invention is to provide a means for mounting a shelving system on a wall that does not hinder access to the shelves.

Still a further object of the present invention is to provide a wall mounting system for shelves that will securely hold the shelves in place so that they will not be inadvertently disengaged.

In the preferred embodiment of the invention, at least one shelf is mounted on a wall or other support surface by means of a pair of c-shaped brackets and a pair of tubular braces. The brackets are adapted to be mounted on the wall and to removably hold the back of the shelf. The tubular braces are each provided with flattened flange areas at each end, with one flange disposed at a 45° angle to the longitudinal axis of the brace. Each flange area is provided with at least one hole to receive a bolt or screw. Each brace is mounted on the wall on opposite sides of the shelf by placing the angled flange against the wall and screwing a lag bolt through the hole in the flange into the wall. The other flange on each brace is screwed to a side of the shelf. A second shelf can be mounted below the first shelf by means of a second pair of brackets secured to the wall below the first pair of brackets. A pair of support members are secured to the first shelf and extend downwardly therefrom to help support the second shelf, which is secured to the support members below the first shelf. Additional shelves can be added to the system by use of additional brackets and support members.

DETAILED DESCRIPTION OF THE INVENTION

Figure 1:
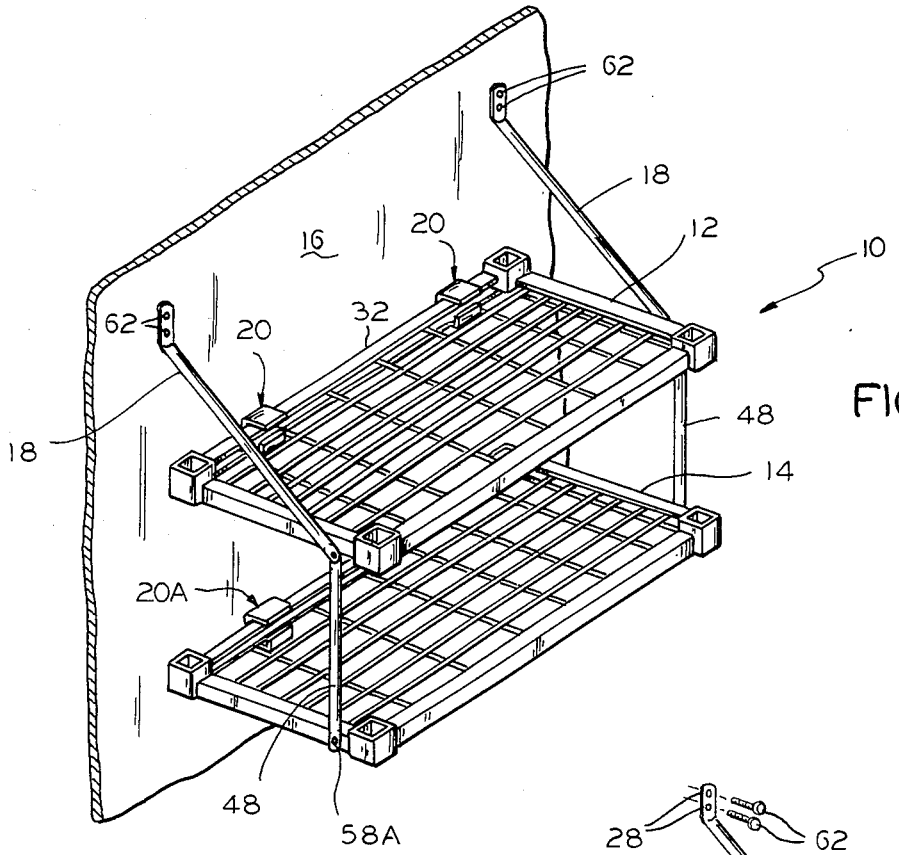
FIG. 1 is an isometric view of a shelf assembly or module mounted on a wall by means of the present invention.
Figure 2:
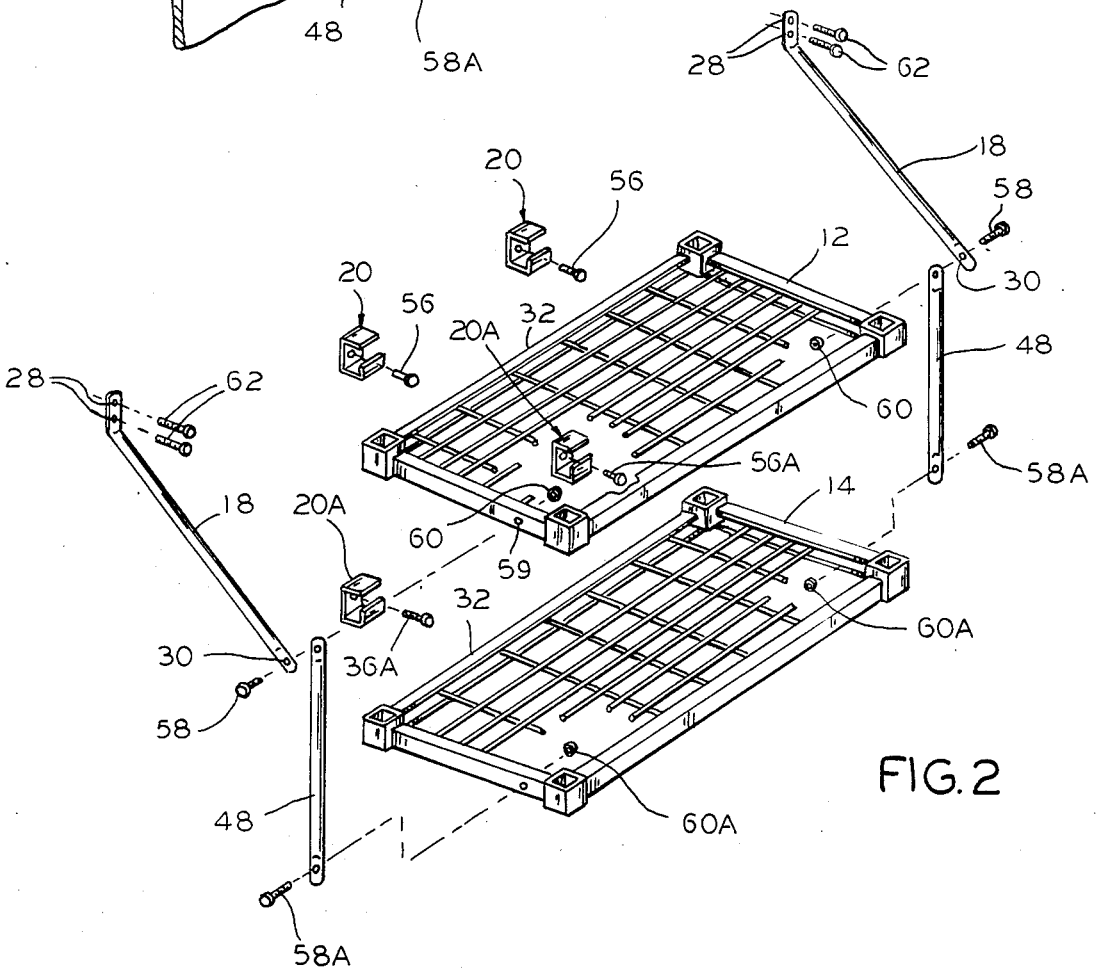
FIG. 2 is an isometric exploded view of the shelf assembly of FIG. 1.

Referring to FIG. 1, shelf assembly 10 comprises shelves 12 and 14, which are mounted to wall 16 by means of angle braces 18 and brackets 20. Although only two shelves are shown, such an assembly or module often comprises three or more shelves, depending on storage requirements.

Figure 3:
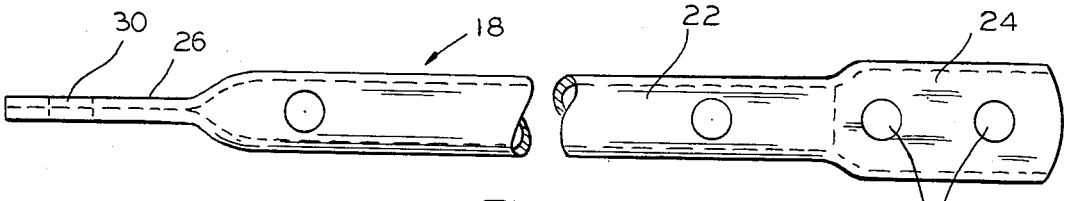
FIG. 3 is a side view of an angle brace that comprises part of the invention.
Figure 4:
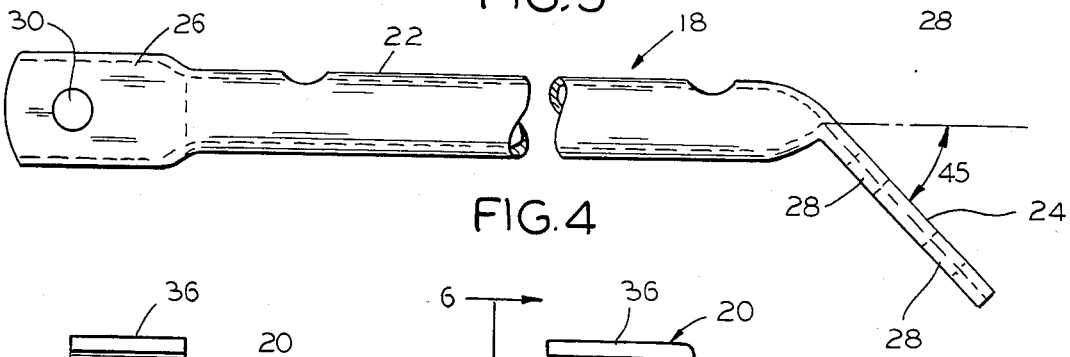
FIG. 4 is a plan view of the angle brace shown in FIG. 3.

As shown in FIGS. 3 and 4, brace 18 comprises a central tubular portion 22 with the ends flattened to form flanges 24 and 26. Flange 24 is bent at a 45° angle to the longitudinal axis of central tubular portion 22 and two holes 28 are formed in the flange for securing the brace to a wall or other support surface as explained below. Hole 30 is provided in flange 26 for securing the brace to a shelf and is sized to receive a machine screw.

Figure 6:
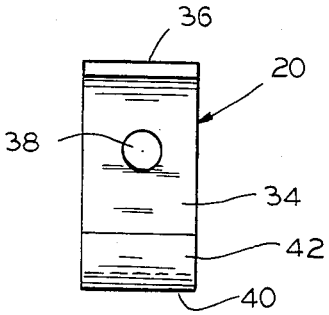
FIG. 6 is a view of the shelf bracket taken along line 6—6 in FIG. 5.
Figure 5:
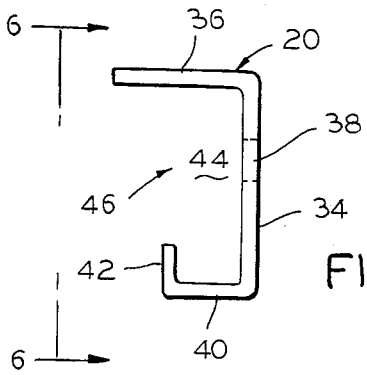
FIG. 5 is a side elevation view of a shelf bracket that comprises of the invention.
Figure 7:
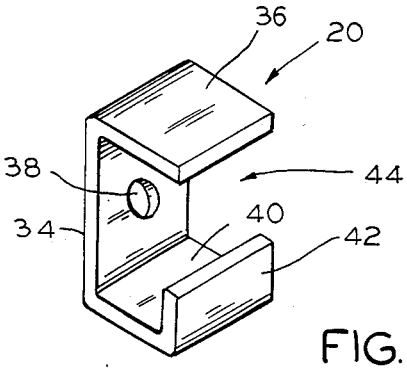
FIG. 7 is an isometric view of the shelf bracket of FIGS. 5 and 6.

Referring to FIG. 5–7, bracket 20 forms a c-shaped opening to receive and hold the channel or frame 32 of shelf 12 or 14. Backwall 34 extends downwardly from and is perpendicular to top wall 36. Hole 38 is provided in backwall 34 to receive a lag bolt for securing the bracket to wall 16. Bottom wall 40 extends outwardly from backwall 34 parallel to top wall 36 and terminates in an upwardly extending lip 42. Thus, as can be seen, bracket 20 forms an interior space 44 with opening 46 to receive and hold frame or channel 32.

Figure 9:
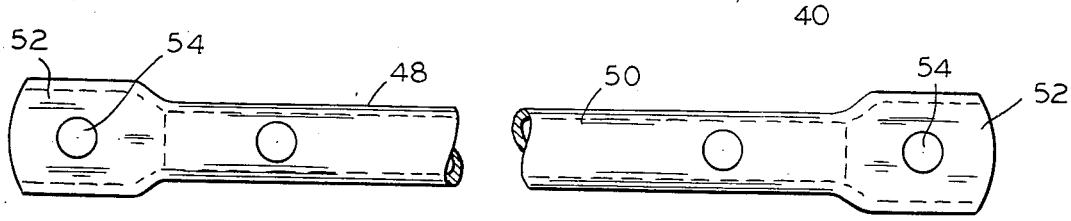
FIG. 9 is a plan view of a brace that comprises part of the invention.
Figure 10:
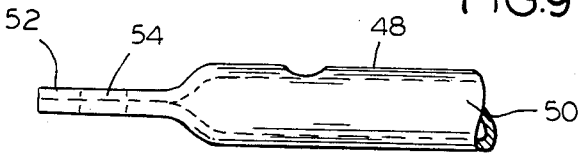
FIG. 10 is a partial side elevation view of the brace shown in FIG. 9.

Referring to FIG. 9, vertical brace 48 comprises a central tubular portion 50 and flattened end flanges 52, each provided with a hole 54 to receive a machine screw. The vertical brace can be made in any desired length.

To assemble a shelving assembly or module 10 as shown in FIG. 1, the height of the top shelf in the assembly is first determined and marked on wall 16. A pair of brackets 20 are then mounted on wall 16 by means of lag bolts 56 at the height of the top shelf as marked on the wall. The lag bolts 56 are screwed into the wall 16 through holes 38 on each bracket 20.

Typically, wall 16 is supported by wooden studs (not shown) that are spaced on sixteen inch centers. Brackets 20 should be located on wall 16 so that lag bolts 56 can be screwed into the wooden studs to properly support the shelf assembly. For shelves 48 inches and smaller in length, brackets 20 are normally spaced thirty-two inches apart.

After brackets 20 are installed on wall 16, braces 18 are attached to each side of the shelf 12 by means of machine screws 58 and nuts 60. Screws 58 fit through holes 30 on flanges 24 of the braces 18 and through holes 59 in shelf frame 32. At this time, vertical braces 48 are also secured to shelf 12 by means of machine screw 58 and nuts 60 to support shelf 14, as later explained. Nuts 60 are not completely tightened at this time in order to leave some play in braces 18 for proper positioning on wall 12.

Securing shelf 12 to braces 18 by means of screws 58 and nuts 60 provides a convenient means of installation that also prevents inadvertent disengagement of shelf 12 from braces 18.

Of course, if only shelf 12 is to be installed, vertical braces 48 are not secured to shelf 12.

Figure 8:
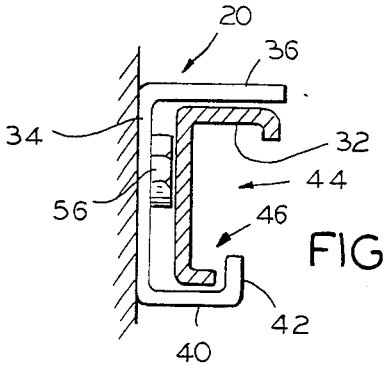
FIG. 8 is a partial cross-sectional view of a shelf held by the shelf bracket of FIG. 5.

After braces 18 and 48 are secured to shelf 12, the shelf is placed in brackets 20. The back of the shelf frame 32 is aligned with opening 46 on bracket 20 and is positioned so that shelf 12 is inclined slightly doWnWardly from back to front. The shelf 12 is then pivoted upwardly as it is placed in opening 46 so that frame 32 slips into interior space 44 as shown in FIG. 8. As can be seen in FIG. 8, frame 32 is securely held in space 44 of bracket 20, but can be easily removed from the bracket if desired by pivoting shelf 12 downwardly and pulling frame 32 outwardly through opening 46. As shown in FIG. 8, frame 32 rests on bottom wall 40. Top wall 36 and lip 42 prevent frame 32 from being inadvertently dislodged from bracket 20.

Once shelf 12 is secured in brackets 20, braces 18 can be secured to wall 16 by means of lag bolts 62, which are screwed into the wood studs (not shown) in wall 16 through holes 28 in flanges 24. Nuts 60 on machine screens 58 can then be tightened so that braces 18 and 48 are securely held in place.

Once top shelf 12 is secured, shelf 14 can be mounted in the assembly 10. A second pair of brackets 20A are aligned on wall 16 at approximately the same height as the bottom of vertical braces 48. The second pair of brackets 20A are located directly beneath the first pair of brackets 20 that support top shelf 12 so that they are positioned over a pair of wooden studs. A lag bolt 56A is screwed through hole 38 on each bracket 20A to secure the bracket to wall 16.

The back of shelf frame 32 is then aligned with opening 46 and pivoted upwardly into the bracket 20A in the same manner shelf 12 was secured in place in brackets 20. Vertical braces 48 can then be attached to shelf 14 by means of machine screws 58A and nuts 60A. If further shelves are to be added to the assembly 10 below shelf 14, another pair of vertical braces (not shown) extending downwardly from shelf 14 are secured to the shelf by means of screws 58A and nuts 60A.

By repeating the above-described process, additional shelves can be added to or removed from assembly 10 as desired to meet different storage requirements. Of course, in adding more shelves to assembly 10, vertical braces of different lengths can be used to vary shelf heights as storage requirements may dictate.

Those who are skilled in the art will readily perceive how to modify the shelf assembly invention. Therefore, the appended claims are to be construed to cover all equivalent structures which fall within the true scope and spirit of the invention.

The invention claimed is:

1. A shelf system mounted on a wall comprising at least two shelves; a first pair of brackets adapted to be mounted on said wall at any desired location to receive and removably hold one of said shelves; a first pair of braces mounted on said wall and secured to said one shelf; a second pair of brackets adapted to be mounted on said wall at any desired location beneath said first pair of brackets to receive and removably hold said other shelf; wherein each bracket in said first and second pairs of brackets is C-shaped with an interior space that opens external of said bracket, said interior space adapted to receive and removably hold said shelves; and a pair of support members removably secured to said one shelf and extending downwardly therefrom, said other shelf removably secured below said one shelf to said second pair of brackets and to said pair of support members.

2. The shelf system of claim 1 wherein each of said pair of braces is formed from a tubular member with flattened flange areas disposed at each end thereof, one of said flange areas on each brace disposed at a 45° angle to the longitudinal axis of said tubular member and each of said flange areas being provided with at least one hole to receive a bolt or screw for mounting the braces to said wall and for securing the braces to said shelf.

3. The shelf system of claim 2 wherein said support member is formed from a tubular member with flattened flange areas disposed at each end thereof and each of said flange areas is provided with a hole to receive a screw for securing said support members to said shelves.

4. The shelf system of claim 1 including a third shelf disposed below said other shelf; a third pair of brackets adapted to be mounted on said wall below said second pair of brackets to removably hold said third shelf; and a second pair of support members removably secured to said other shelf and extending downwardly therefrom, said third shelf removably secured to said third pair of brackets and said second pair of support members below said other shelf.

5. A shelf system mounted on a wall comprising at least a first shelf, at least one bracket adapted to be mounted on said wall to receive and removably hold said first shelf; at least one brace mounted on said wall and secured to said first shelf; at least one support member removably secured to and extending downwardly from said first shelf; and a second shelf removably secured to said support member beneath said first shelf.

6. The shelf system of claim 5 including a second bracket mounted on said wall below said first shelf adapted to receive and removably hold in place said second shelf.

7. The shelf system of claim 6 wherein each of said first and second brackets is C-shaped with an interior space that opens external of said bracket, said interior space adapted to receive and removably hold said shelves.

8. The shelf system of claim 5 wherein said brace is formed from an elongatyed tubular member with a flattened flange area disposed at each end, one of said flanges being disposed at a 45° angle to the longitudinal axis of said tubular member.

9. The shelf system of claim 6 wherein said support member is formed from an elongated tubular member with a flattened flange area disposed at each end.

* * * * *